US005302143A

United States Patent [19]

Inoue et al.

[11] Patent Number: 5,302,143

[45] Date of Patent: Apr. 12, 1994

[54] BATTERY . TERMINAL

[75] Inventors: Nori Inoue; Masaaki Tabata; Kazumoto Konda, all of Yokkaichi, Japan

[73] Assignee: Sumitomo Wiring Systems, Ltd., Yokkaichi, Japan

[21] Appl. No.: 70,199

[22] Filed: Jun. 2, 1993

[30] Foreign Application Priority Data

Jun. 9, 1992 [JP] Japan ..... 4-39304[U]

[51] Int. Cl.[5] ..... H01R 13/00

[52] U.S. Cl. ..... 439/762

[58] Field of Search ..... 439/754–774

[56] References Cited

U.S. PATENT DOCUMENTS 1,522,728 1/1925 Krohn ..... 439/762
1,746,514 2/1930 Baunach ..... 439/762
2,222,577 11/1940 Thompson ..... 439/762
3,568,139 3/1971 Delzer .

FOREIGN PATENT DOCUMENTS 4-7567 2/1992 Japan .
4-9736 3/1992 Japan .
624673 2/1947 United Kingdom .

*Primary Examiner*—Joseph H. McGlynn
*Attorney, Agent, or Firm*—Sandler, Greenblum & Bernstein

[57] ABSTRACT

A battery • terminal, wherein a pair of right, left clamping plate portions of the terminal main body are inserted into the notch portion of the clamping equipment, the bolt is clamped from above in the vertical direction with respect to the nut through the gap between the right, left clamping plate portions, the right, left clamping plate portions are moved by the taper face of the clamping equipment at the clamping time in the mutually approaching horizontal directions, the electrode engagement portion is adapted to be put into pressure contact against the external peripheral face of the battery • post, so that the terminal can be secured by the clamping operation from the vertical direction or obliquely from above with respect to the battery • post.

6 Claims, 8 Drawing Sheets

BATTERY . TERMINAL

BACKGROUND OF THE INVENTION

The present invention generally relates to a battery • terminal provided on the electrodes (battery • posts) of the battery mounted on an automobile and so on, and more particularly, the battery • terminal is adapted to be mounted from the above portion in the vertical direction so as to improve the operationality, and so on.

Generally, this type of battery • terminal has an electrode engagement portion 3*a* of the battery • terminal (hereinafter referred to as terminal) 3 externally engaged with the battery • posts (hereinafter referred to as posts) 2 projected from the top face of the battery 1 as shown in FIG. 13, a bolt 4 extended in a horizontal direction into the bolt hole of a basic plate portion 3*b* and a clamping plate portion 3*c*, a nut 6 clamped from the horizontal direction with an impact wrench 5 being laid flat horizontally with respect to the bolt 4, the terminal 3 secured to the post 2 with the electrode engagement portion 3*a* being in pressure contact against the post 2.

In recent years, established components have become extremely numerous within the engine compartment of the automobile to have a very high density therein. Projections (for example, air ducts) higher than posts, and electric wires are provided more around the battery. When the bolts 4 are arranged in the horizontal direction as described hereinabove under such situation, and the nuts 6 are clamped with the impact wrench 5 being laid flat, the impact wrench interferes with the other parts and is hard to clamp. The impact wrench cannot be clamped with no space for installing thereof in the horizontal direction.

When the impact wrenches interfere with the other components, for example, the clamping operation of the post on+side is effected, a short circuiting operation is caused if the impact wrench comes into contact with the post on side so as to cause the vehicle fire in the worst case. In order to prevent the above described interference, there is a problem that the other parts have to be changed in shape.

A battery • terminal where a bolt 4 is arranged inclined at an acute angle with respect to the axial line of the electrode engagement portion of the terminal 3 and the nut 6 is adapted to be clamped from the oblique upper portion by the impact wrench 5, as shown in FIG. 14, with respect to the above described problem (Japanese Utility Model Publication No. 4-7567.)

A basic plate portion 3*b*' and a clamping plate 3*c*' are formed oppositely so that a taper spreading downwards is provided, a tightening plate 7 whose both sides are downwards spread is astride the above described basic plate portion 3*b*' and a clamping plate 3*c*'.A basic plate portion 3*b*' and a clamping plate 3*c*' are clamped by the tightening plate 7 by the clamping operation of the bolt 4 from above. A battery • terminal is provided which is adapted to depress the electrode engagement portion 3*a*' against the post 2 (Japanese Utility Model Publication Jitsukohei No. 4-9736.)

In the above described battery • terminal conventionally provided, torsion is added with an angle so that the basic plate portion 3*b* and a clamping plate 3*c* may be inclined with respect to the axial direction of the electrode engagement portion 3*a* so as to clamp the nut 6 from the oblique upper portion in the above described terminal. As the clamping direction between the basic plate portion 3*b* and the clamping plate 3*c* formed with this angle torsion is different from the direction in which the electrode engagement portion 3*a* comes into pressure contact against the external peripheral face of the battery • post, thus resulting in a problem that the clamping force cannot be burdened sufficiently in the pressure contact direction of the electrode engagement portion.

In a battery • terminal shown in FIG. 15, the clamping force of the bolt is externally spread and both the sides 7*a*, 7*b* of the tightening plate does not burden sufficiently the internal clamping force upon the basic plate portion 3*b*' and the clamping plate 3*c*', with a disadvantage that the electrode engagement portion 3*a*' cannot be put into positive pressure contact against the post 2.

SUMMARY OF THE INVENTION

Accordingly, the present invention has been developed with a view to substantially eliminating the above discussed drawbacks inherent in the prior art, and for its essential object to provide an improved battery • terminal.

Another important object of the present invention is to provide an improved battery • terminal where the impact wrench is adapted not to positively interfere with the other components by the clamping operation of the bolt from above with the clamping direction of the bolt being made vertical or oblique and upper, and the clamping force of the bolt from above is converted into the horizontal direction, the side of the free end of the electrode engagement portion is clamped in a closing direction, and the electrode engagement portion is adapted to be positively put into pressure contact with respect to the post.

In accomplishing these and other objects, according to one preferred embodiment of the present invention, there is provided a battery • terminal having a terminal main body composed of a pair of right, left clamping plate portions respectively coupled to the opened free ends of the circular ring shaped electrode engagement portion to be externally engaged with the battery • post, and the above described electrode engagement portions or an electric wire connecting portions connected with either of the clamping plate portions, and a clamping equipment having a notch portion provided, having a taper face opposite into the horizontal direction and spreading downwards, characterized in that a pair of right, left clamping plate portions are inserted into the notch portion of the above described clamping equipment, the above described bolt is clamped from above with respect to the nut through the gap between the right, left clamping plate portions, the external ends of the right, left clamping plate portions are depressed by the taper face of the clamping equipment at the clamping time so as to move the right, left clamping plates in a mutually approaching horizontal direction, the above described electrode engagement portion is adapted to be put into pressure contact against the external peripheral face of the battery • post.

The above described terminal main body has an electrode connecting basic plate portion, an electrode engagement portion and both the upper, lower side portions with a pair of right, left clamping plate portions being respectively connected, the tip end of the clamping plate portion bent into a shape with both the upper, lower side portions being integrated, the above described nut arranged in the gap portion between the upper, lower opposite faces of a pair of right, left clamping plate portions, the taper faces of the above described clamping tool being adapted to come into pressure contact against the respective external ends of the upper, lower clamping plate portions.

Both the upper, lower side portions, which are not necessarily to be provided, are preferable with the contact area being increased, because the clamping force is increased with both the upper, lower side portions being provided, and also, the electrode engagement portions with respect to the battery • post become an upper, lower pair.

A projection face is provided between these taper faces with a pair of right, left taper faces to be formed in the notch portion of the above described clamping plate portion as two stages of taper faces coming into pressure contact respectively with the upper, lower clamping plate portions, and it is desirable to insert the projection face into between the upper, lower clamping plate portions. One stage of taper face is provided without provision of two stages of taper faces on a pair of right, left taper faces, while the respective external end faces of the upper, lower clamping plate portions may be provided as taper faces corresponding to the above described taper face.

It is desirable that guide grooves with which the taper faces of both the side portions of the clamping equipment are engaged be provided on each of the above described clamping plate portions.

It is desired that a bolt be clamped from the vertical upper portion with respect to the nut through a nut between the clamping plate portions on both the upper, lower sides to be arranged in parallel with the clamping plate portions on both the upper, lower sides being all provided in a horizontal direction.

The bolt can be clamped on a nut arranged with a bolt being in contact with the lower face of the clamping plate portion on the upper side from the oblique upper portion with the clamping plate portion on the upper side being made oblique and also the clamping plate portion on the bottom side being made horizontal.

A pair of right, left clamping plate portions in the vertical direction respectively connected from the free ends of the electrode engagement portions without the terminal main body being bent at one end to effect the upper, lower opposite directions. A nut mounting hole is provided opposite to the central portion these clamping plate portions with both the sides thereof being inserted into the nut mounting holes so as to arrange a nut with a tapped hole in its central portion being provided in it, the above described clamping equipment has a notch portion provided on one side portion with a taper face to be spread downwards oppositely in the horizontal direction, and the bolt can be clamped on the above described nut with the above described taper face being arranged on the external face of the above described pair of right, left clamping plate portion tip ends.

In the above described terminal main body, an electric wire connecting portion and a pair of right, left clamping plate portions may be formed with the electrode engaging portion being grasped therebetween, and the electric connecting portion may be connected with any one of the right, left clamping plate portions.

Clamp the bolt on the nut through between the right, left clamping portion plate from above in the vertical direction in the above described construction, and the clamping force in the direction from above is converted into the horizontal direction by the taper face of the clamping equipment, and the external ends of the right, left clamping plates can be clamped in a mutually approaching direction. Clamp the free end of the electrode engagement portion connected with the right, left clamping plate portions in the closing direction, and the electrode engagement portion can be secured in pressure contact against the external peripheral face of the battery • post.

BRIEF DESCRIPTION OF THE DRAWINGS

These and other objects ad features of the present invention will become apparent from the following description taken in conjunction with the preferred embodiment thereof with reference to the accompanying drawings, in which.

DETAILED DESCRIPTION OF THE INVENTION

Figure 1:
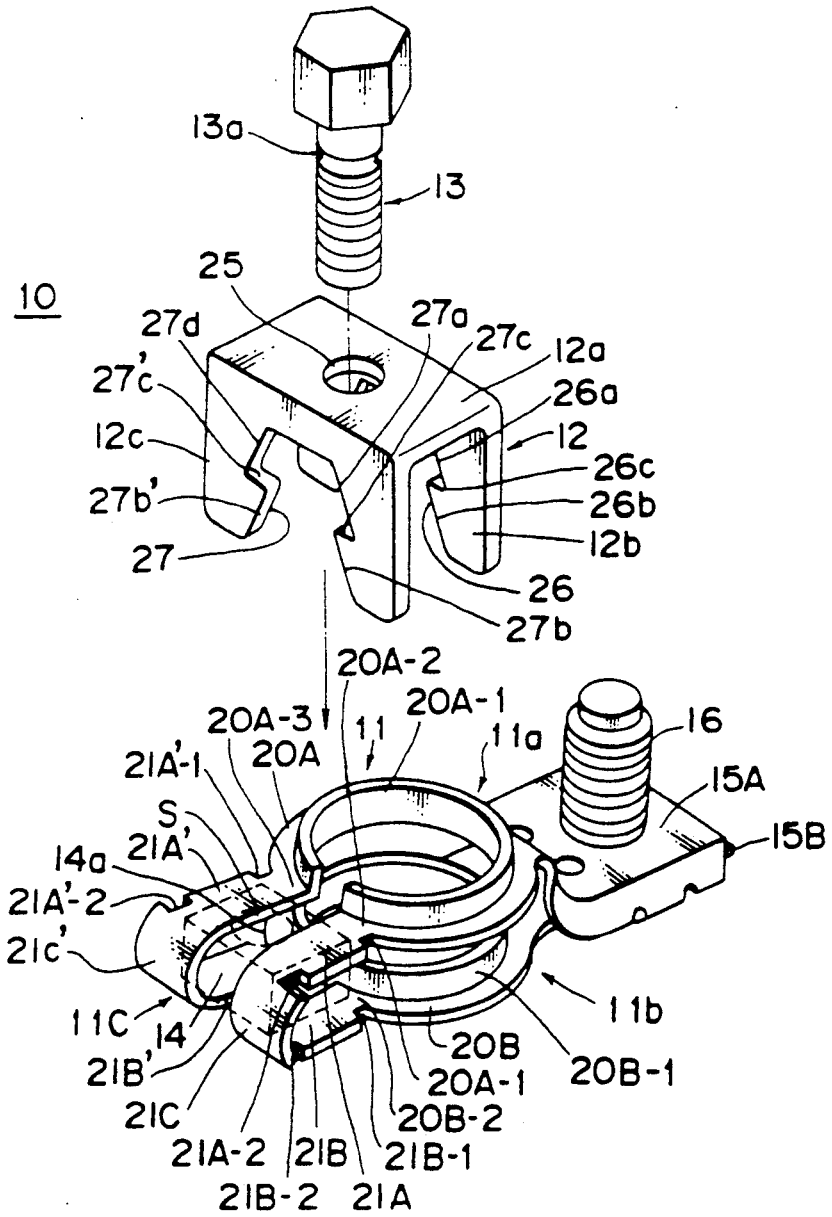
FIG. 1 is an exploded perspective view of a battery • terminal in a first embodiment of the present invention.

Before the description of the present invention proceeds, it is to be noted that like parts are designated by like reference numerals throughout the accompanying drawings.

The present invention will be described hereinafter in detail with reference to the drawings.

FIG. 1 through FIG. 4 show a first embodiment. A battery • terminal 10 is composed of a terminal main body 11, a clamping element 12, a bolt 13 and a nut 14 as shown in FIG. 1.

Figure 4:
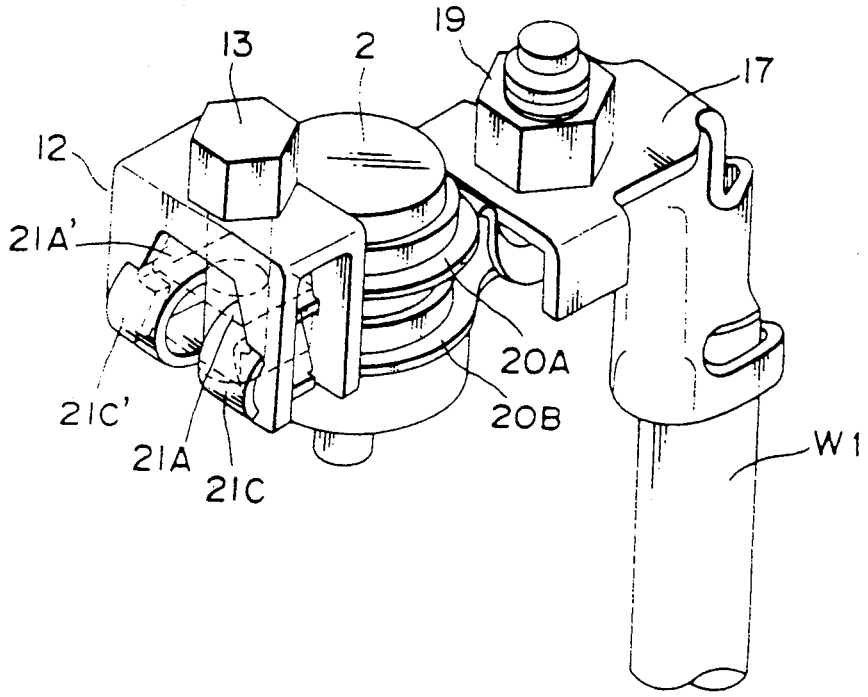
FIG. 4 is a perspective view after the engagement with the battery • post in the first embodiment.

The terminal main body 11 is a stud type. A piece of metallic plate is bent, worked as shown. A stud bolt 16 is projected from the basic plate portion 15A for electric wire connection use at one end thereof. Terminals 17, 18 with electric wires W1, W2 being put under pressure contact against them are clamped with a nut 19, as shown in FIG. 4, for connecting operation.

The above described terminal main body 11 is shaped in upper, lower opposite positions with the upper side portion 11*a* and the lower side portion 11*b* each being approximately formed in the schematically same shape being bent with a bulge portion 11*c* on end side.

Both the upper side portion 11*a* and the lower side portion 11*b* are provided with basic plate portions 15A, 15B for electric wire connecting use of approximately rectangular shape in one end. A basic plate portion 15B for electric wire connection use on the lower side is adapted to be inserted between them with both the sides of the basic plate portion 15A for electric wire connection use on the upper side being downwardly bent.

The electrode engagement portions 20A, 20B which are made circular in shape are connected from the basic plate portions 15A, 15B for the above described electric wire connecting use. Cylindrical portions 20A - 1, 20B - 1 are erected along the inner peripheral edges on the electrode engagement portions 20A, 20B. The cylindrical portions 20A - 1, 20B - 1 are adapted to come into pressure contact against the outer peripheral face of the battery • post.

The tip ends of the above described circular ring shaped electrode engagement portions 20A, 20B are open as shown. The respectively connected clamping plate portions 21A, 21A'', 21B, 21B' are provided on the respective free ends 20A - 2, 20A - 3, 20B - 2, 20B - 3 (in the drawings, 20B - 3 is not shown), and the clamping plate portions 21A and 21B, 21A' and 21B' are connected with bent portions 21C, 21C' in the upper, lower directions. A gap S is provided between the above described right, left clamping plates 21A and 21A', 21B and 21B'.

Guide grooves 21A - 1, 21A - 2, 21A' - 1, 21A' - 2 and 21B - 1, 21B - 2, 21B' - 1, 21B' - 2 (21B' - 1 and 21B' - 2 are not shown) for engaging for its free sliding operation both the side portions of the clamping equipment 12 are formed on both the side portions for connecting the electrode engaging portion side and the bent portion side of the clamping plate portions 21A, 21A', on the upper side and the electrode engaging portions sides of the clamping plates 21B, 21B, on the lower side'.

A nut 14 is inserted into among the above described a pair of right, left and upper, lower clamping plates.

The female tapped hole 14*a* of the nut 14 is adapted to be positioned in a gap S between the right, left clamping plates 21A ad 21A'.

The clamping equipment 12 is approximately upside down ]-character in shape with a top face portion 12*a* and both the side portions 12*b*, 12*c* being provided on it. A bolt through hole 25 is drilled at the center of the top face portion 12*a*. The interval between both the side portions 12*b* an 12*c* projected in the vertical direction from both the ends of the top face portion is equal to the interval between the guide grooves 21A - 1 and 21A - 2 . . . 21B' - 1, 21B' -2 formed in the above described respective clamping plates 21A, 21A', 21B, 21B'.

Notch portions 26, 27 of lower end opening provided in the central portion as shown are provided in both the above described side portions 12B, 12*c*. Taper faces 26*a*, 26*b*, 26*a*', 26*b*', 27*a*, 27*b*, 27*a*', 27*b*' spread towards the downward direction of the upper, lower two stages opposite into the horizontal direction are formed on both the right, left side end faces of the notch portions 26, 27 with the continuous portions of these taper faces being projection faces 26*c*, 26*c*', 27*c*, 27*c*'.

The bolt 13 is of a diameter to be screwed into a female tapped hole 14*a* of a nut 14 through a bolt hole 25 of the clamping element 12. A ring mounting groove 13*a* is provided above the shaft portion of the bolt 13, a ring 29 is mounted, as shown in FIG. 3, on the ring mounting groove 13*a* after the passing into the bottle hole 25 and the clamping element 12 is interlocked, raised when the bolt 13 is raised while being loosened.

The engaging operation of the above described terminal with respect to the battery • post will be described hereinafter.

Figure 2:
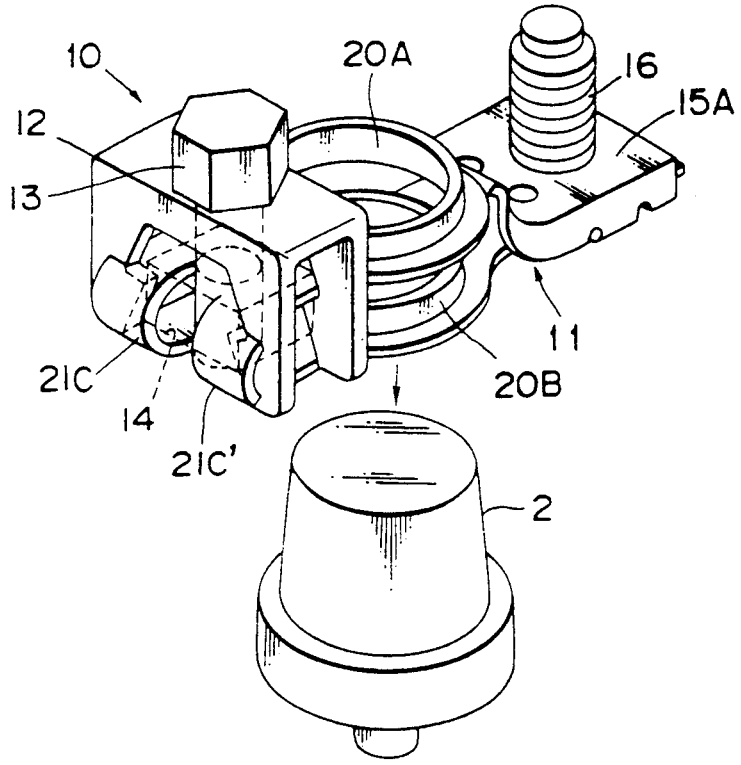
FIG. 2 is a perspective view before the engagement with the battery • post in the first embodiment.
Figure 3:
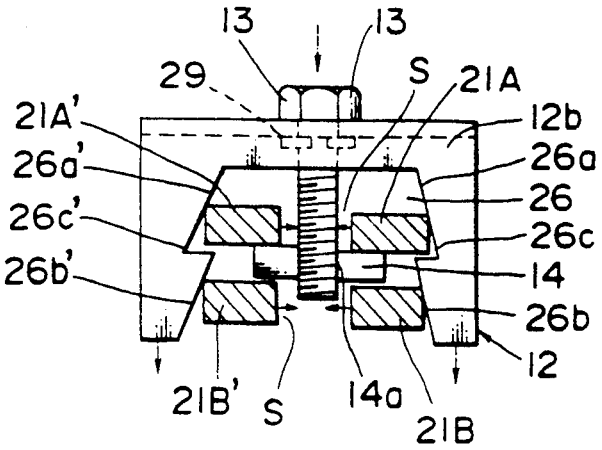
FIG. 3 is a sectional view showing a bolt clamping operation in the first embodiment.

The bolt 13 is temporarily engaged with the nut 14 before the engaging operation in the condition shown in FIG. 2 and FIG. 3, and both the side portions 12*b* and 12*c* of the clamping element 12 are inserted for the free slidable operation into the guide grooves 21A - 1 through 21B' - 2 of the clamping plate portion 21A through 21B' of the terminal main body 11. The taper faces 26*a*, 26*b*, 26*a*', 26*b*' of the notch portion 26 of one side portion 12*b* are in light contact with the upper side external end portions of the clamping plate portions 21A, 21B, 21A', 21B' of the terminal main body 11. The projected faces 26*c*, 26*c*' are projected into the gap portion, namely, both sideways of the nut 14 between the clamping plate portions 21A and 21B, 21A' and 21B'.

At the above described temporarily clamping operation, the bolt 13 is connected with the nut 14. As the clamping plate portions 21A an 21A' on the upper side are supported with the nut 14 and also, the projection faces 26*c*, 26*c*' are projected onto the lower sides of the clamping plate portions 21A and 21A' on the upper side, positive temporary engagement is effected so that the clamping equipment 12 is not disengaged from the terminal main body 11.

The same thing can be said even about the side of the notch portion 27, and only the side of the notch portion 26 shown in FIG. 3 will be described hereinafter.

A gap S is provided between the clamping plate side portions 21A and 21A', 21B and 21B' on both the sides in the above described temporarily clamping condition. The free end sides of the electrode engagement portions 20A and 20B connected with the clamping plate portions are on a wide opening condition.

The above described pair of upper, lower electrode engagement portions 20A and 20B are externally engaged from above with respect to the post 2 of the battery. The engagement can be easily effected because of widely empty location on the free end side.

The bolt 13 is downwardly clamped with the use of an impact wrench (not shown) from above in the vertical direction as shown with arrow marks in FIG. 3. The clamping element 12 is moved downwards with the clamping operation and the taper face 26*a* of the notch 26 depresses the clamping plate portion 21A inwardly as shown with arrow marks. The clamping plate portion 21B is depressed by the taper face 26*b*, the clamping plate portion 26A' by the taper face 26*a*', the clamping plate portion 21B' by the taper face 26*b*'. The clamping plate portion is depressed inwardly by the taper face of the notch portion 27 even in the other side portion of the clamping equipment 12 as described hereinabove.

The clamping force in the vertical direction with the bolt 13 is changed in the horizontal direction by the taper face in this manner. The clamping plate portions 21A and 21A', 21B and 21B' on both the right, left sides are moved in the mutually approaching directions so as to clamp the free ends of the coupled electrode engagement portions 20A, 20B in the closing direction. The electrode engagement portions 20A and 20B are bought into pressure contact against the external peripheral face of the post 2 and the terminal main body 11 is fixedly connected with the post 2 as shown in FIG. 4.

As a nut 14 is positioned between the clamping plate portions 21A, 21A' on the upper side and the clamping plate portions 21B, 21B' on the lower side at the clamping operation by the above described bolt 13, the terminal main body 11 can be prevented from being deformed or crushed.

Figure 5:
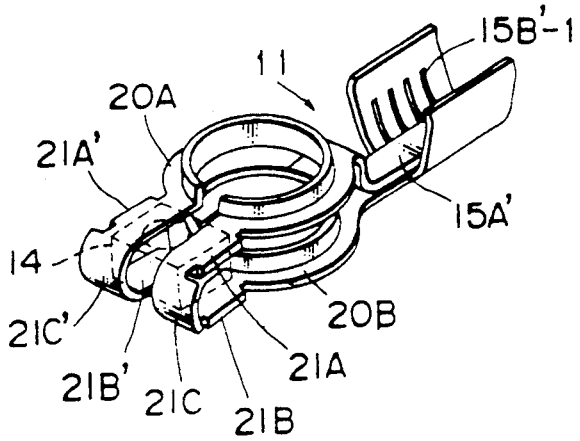
FIG. 5 is a perspective view of a terminal main body of a battery • terminal in a second embodiment.

FIG. 5 shows a second embodiment of the present invention and the above described terminal main body 11 is a stud type. The terminal main body 11 in a second embodiment has the basic plate portion for electric wire connection use provided as an electric wire adhering type.

The upper basic plate portion 15A' for electric wire connection use connected with the circular ring shaped electrode engagement portion 20A is made in the shape of a slender plate. A barrel 15B' - 1 for electric wire pressure adhering use is projected integrally from both the sides of the slender plate shaped basic plate portion on the basic plate portion 15B' for electric wire connection use connected with the electrode engagement portion 20B on the lower side. The basic plate portion 15A' for electric wire connection use on the upper side is formed in a superposed condition on the bottom portion of the basic plate portion 15B' for the electric connection use on the lower side.

The electric wire is inserted into the above described electric wire connecting basic plate portion and the electric wire is connected with pressure adhering operation by the barrel 15B' - 1.

The other shape of the terminal main body in a second embodiment is the same as in the first embodiment. As the engagement with respect to the post is also the same, the description will be omitted.

Figure 6:
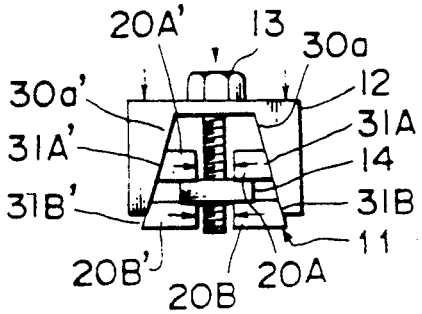
FIG. 6 is a sectional view of the essential portions in a third embodiment.

FIG. 6 shows a third embodiment, and one pair of taper faces 30*a*, 30*a*' are formed, without provision of the taper face by two stages, on the notch portions 26, 27 of both the side portions 12*b*, 12*c* of the clamping equipment 12.

The taper faces 31A, 31A', 31B, 31B' are formed on the external end faces of the clamping plate portions 21A, 21A', 21B, 21B' of the terminal main body 11.

When the bolt 13 is clamped downwardly from above even in the above described construction, the clamping force in the vertical direction of the bolt 13 is converted in the horizontal direction by the contact operation through the contact operation between the taper faces 30*a*, 30*a*' of the clamping equipment 12 and between the taper faces 31A, 31B, 31A' and 31B' of the clamping plate equipment 12. The free end of the electrode engagement portion connected as in the first embodiment are closed with the mutual approaching operation between the right, left clamping plate portions 21A and 21A', 21B and 21B', so that the electrode engagement portion can be fixed with pressure contact against the post.

Figure 7:
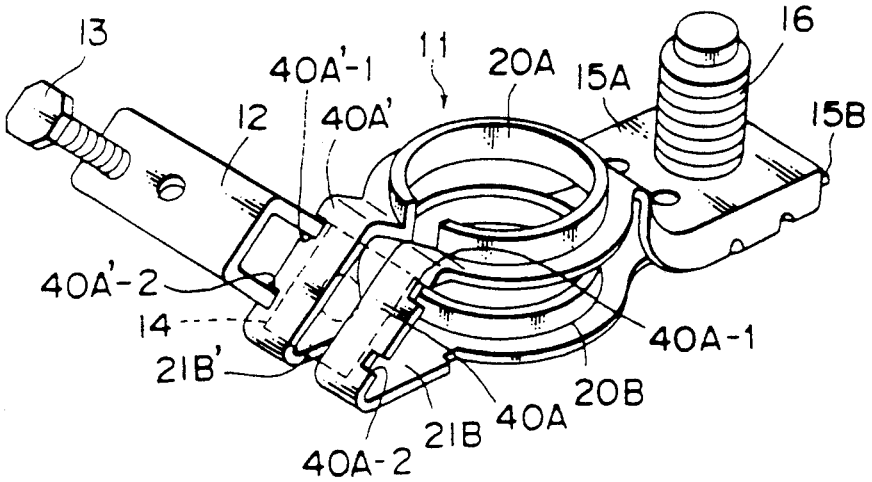
FIG. 7 is an exploded perspective view of a battery • terminal in a fourth embodiment.
Figure 8:
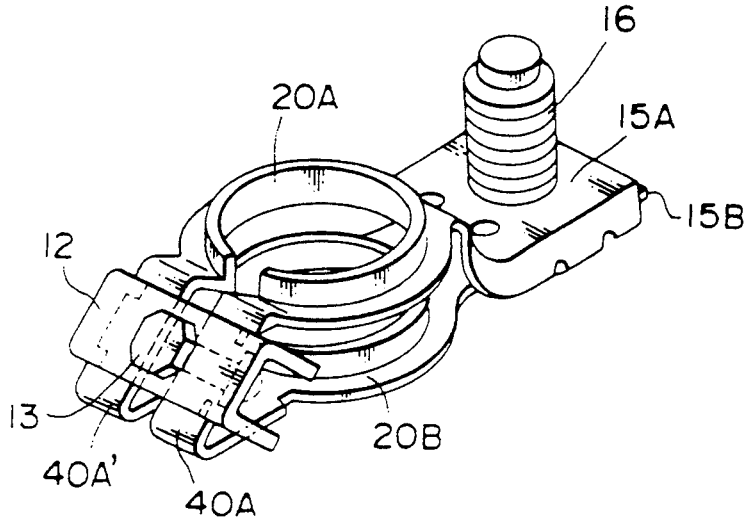
FIG. 8 is a perspective view before the engagement with the battery • post in the fourth embodiment.

FIG. 7 and FIG. 8 show a fourth embodiment of the present invention. The bolt 13 is adapted to be clamped obliquely from above.

The clamping plate portions 40A, 40A' on the upper side of the terminal main body 11 are inclined and are connected with the lower side clamping plate portions 21B, 21B' in the horizontal direction from the lower end point of the tip end thereof.

Only the clamping plate portions 40*a*, 40A' on the upper side are adapted to be clamped with the clamping equipment 12 in a fourth embodiment so that the guide grooves 40A - 1, 40A - 2, 40A' - 1, and 40A' - 2 are formed only upon the clamping plate portions 40A, 40A' on the upper side.

The nut 14 is arranged in a condition where it is in contact with the bottom faces of the upper side clamping plate portions 40A and 40A' so that the direction of the female tapped hole of the nut 14 in the insertion direction of the bolt 13 to be inserted obliquely from above may be confirmed.

As the other shape of the terminal main body 11 and the shape of the clamping equipment 12 are similar to that of the first embodiment, the description will be described hereinafter.

In the fourth embodiment, FIG. 7 shows the condition before the engagement thereof, and FIG. 8 shows a condition where a clamping equipment 12 is temporarily engaged with the terminal main body 11.

The electrode engagement portions 20A, 20B are externally engaged with the battery • post in a condition shown in FIG. 8 so as to clamp the bolt 13 obliquely from above, and the clamping operation is effected in the approaching direction between the upper side clamping plate sides 40A ad 40A' by the taper face of the clamping element 12. The free ends of the electrode engagement portions 20A and 20B are moved in the closing direction so that the pressure contact operation can be effected against the external peripheral face of the battery • post.

Figure 9:
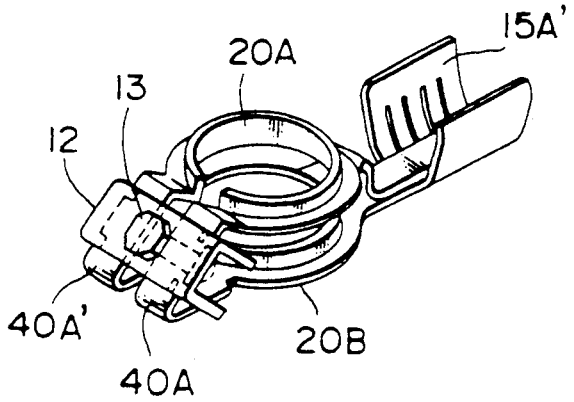
FIG. 9 is a perspective view in a fifth embodiment.

In a fifth embodiment shown in FIG. 9, the terminal main body 11 in the above described fourth embodiment will be omitted in description with the same reference characters, because it is an electric wire pressure adhering type similar to the second embodiment.

Figure 10:
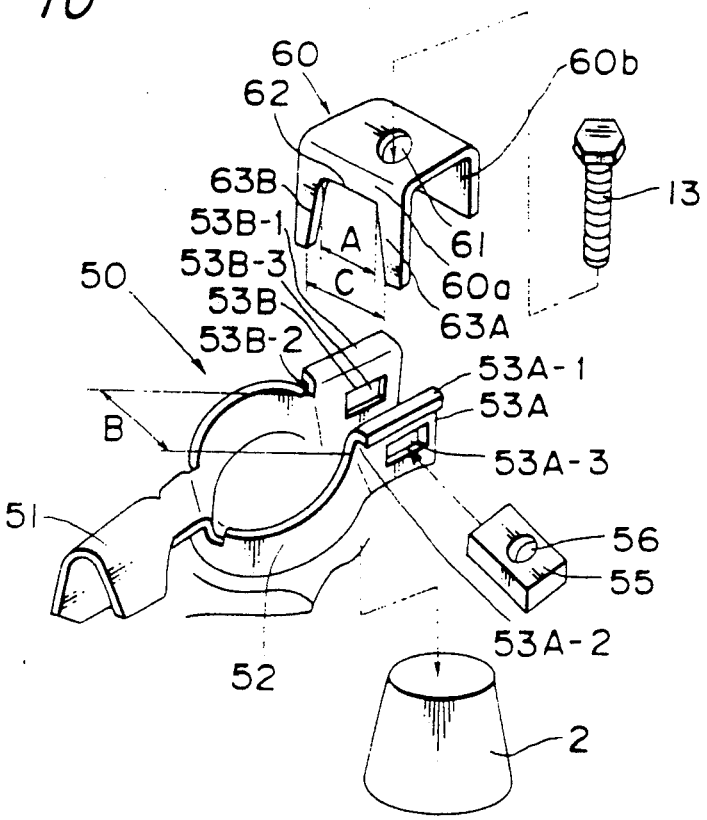
FIG. 10 is an exploded perspective view in a sixth embodiment.
Figure 11:
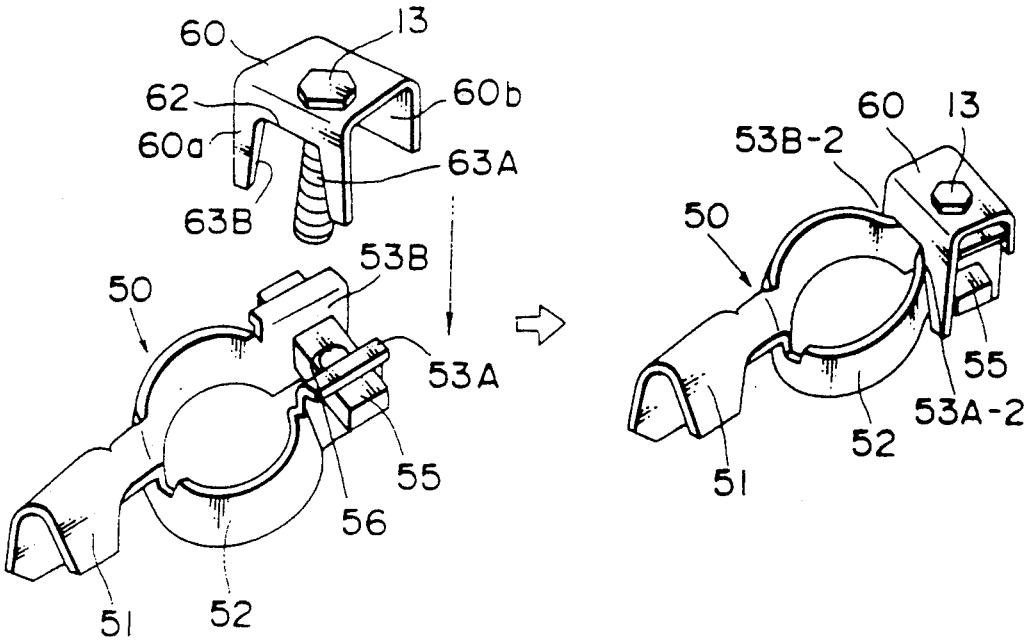
FIG. 11 is a perspective view showing the operation in the sixth embodiment.

FIG. 10 and FIG. 11 show a sixth embodiment. The terminal main body 50 in the present embodiment is different from the terminal main body in the above described first embodiment through the fifth embodiment with the terminal main body 50 being not the construction of the upper and lower clamping parts.

The electric wire connection portion 51 of a barrel type is provided on one end, and a circular ring shaped electrode engagement portion 52 connected with the electric wire connecting portion 51 is provided as shown. A pair of right, left clamping plate portions 53A, 53B projected in the vertical direction are provided respectively at the open free end of the other end of the electrode engagement portion 52. The required gap is provided between the clamping plate portions 53A and 53B.

The clamping plate portions 53A - 1, 53B - 1 each being bent externally are provided on the top ends of the above described respective clamping plate portions 53A, 53B, and neck portions 53A - 2, 53B - 2 are provided with a gap being provided between the tip end of the clamping plate portion and the free end of the electrode engagement portion. Square hole shaped nut mounting holes 53A - 3, 53B - 3 are drilled in the opposite central portions of the respective clamping plate portions.

A rectangular shaped nut 55 is arranged between the above described pair of right, left clamping plate portions 53A and 53B. Both the sides of the nut 55 are inserted into the above described nut mounting holes 53A - 3, 53B - 3 for retaining purpose. A tapped hole 56 is provided in the central portion of the nut 55 and the tapped hole 56 is positioned in the gap between the clamping plate portions 53A and 53B.

The clamping element 60 is approximately ]-shaped in section. The bolt hole 61 is provided in the top face center, and also, a notch portion 62 is provided in one side portion 60*a*. The opposite right, left taper faces 63A, 63B of the notch portion 62 are inclined so as to be downwardly spread.

The interval between the above described taper faces 63A and 63B is adapted to become smaller than the interval between the right, left clamping plate portions 53A and 53B, and is approximately the same on the lower end side.

The notch portion is not provided in the other side portion 60*b* of the clamping equipment 60. The interval between both the side portions 60*a* and 60*b* of the clamping element is set slightly larger than the length of the above described clamping plate portions 53A and 53B. The side portion 60*b* is set to be positioned on the external end faces of the clamping plate portions 53A, 53B at the grasping portion with the above described notch portion 62 being externally engaged with the neck portions 53A - 2, 53B - 2 of the front ends of the clamping plate portions 53A and 53B.

In the above described battery • terminal, the notch portion 62 of the clamping element 60 is mounted, being externally engaged with the right, left clamping plate portions 53A, 53B with a bolt 13 being mounted on the clamping element 60 as shown in FIG. 11 so as to cause the respective taper faces 63A, 63B to contact with the external face sides.

In the temporarily engaged condition, the electrode engagement portion 52 is put on the battery • post 2 so as to clamp the bolt 13 from above into the tapped hole 56 of the nut 55.

The taper faces 63A, 63B are lowered in accordance with the clamping operation of the above described bolt 13 and the right, left clamping plate portions 53A, 53B are moved on the mutually approaching inner sides above the narrow portions of the width. Namely, the clamping force in the upper, lower directions is converted into the clamping force in the right, left directions with the taper face as in the above described first through the fifth embodiments so as to close the free end of the electrode engagement portion 52 for pressure contact against the battery • post 2.

Figure 12:
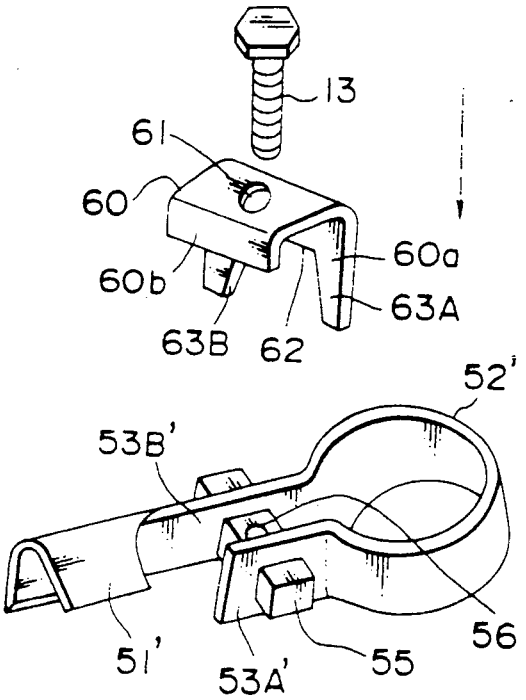
FIG. 12 is an exploded perspective view in a seventh embodiment.
Figure 13:
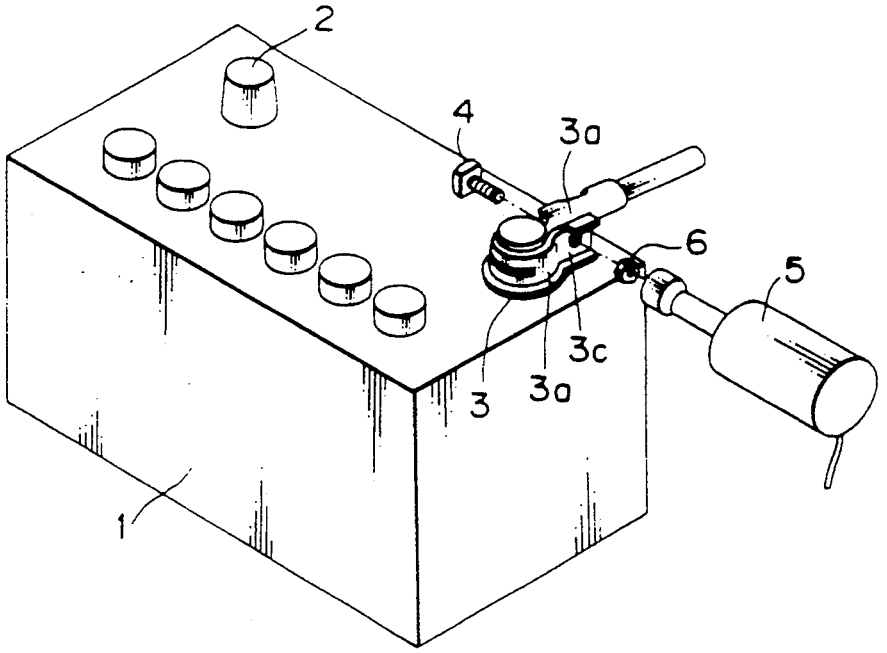
FIG. 13 is a perspective view showing the engagement condition with the battery • post of the conventional battery • terminal.
Figure 14:
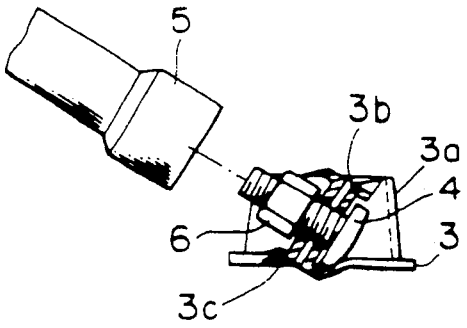
FIG. 14 is a sectional view showing the engagement condition with the conventional other battery • terminal.
Figure 15:
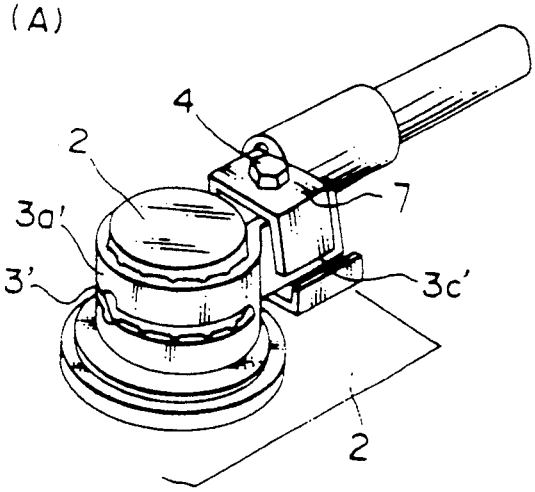
FIG. 15 (A) is a perspective view showing the conventional other battery • terminal, and FIG. 15 (B) is a sectional view for operation explaining use of the battery of FIG. 15 (A).
Figure 15:
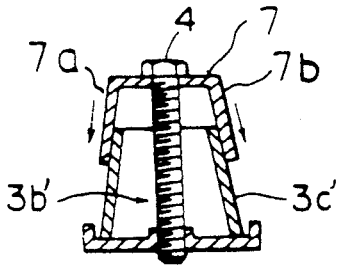

FIG. 12 shows a seventh embodiment of the present invention. In a sixth embodiment, a barrel type of electric wire connecting portion is connected with a pair of right, left clamping plate portions with the electrode engagement portion being grasped. In a seventh embodiment, an electrode engaging portion 52' is formed in the tip end, a pair of right, left clamping plate portions 53A', 53B' are connected from the open free end of the electrode engagement portion 52' so as to connect the barrel type of electric wire connection portion 51' with the tip end of one clamping plate portion 53B'.

As the other construction of the above described seventh embodiment and the clamping operation by the bolt 13 and the nut 55 are similar to the sixth embodiment, the description will be omitted with the same reference characters being given.

As is clear from the foregoing description, according to the battery • terminal of the present invention, a notch portion having the taper face opposite to a clamping element to be clamped from above in the vertical direction or obliquely from above with the bolt is provided. The above described taper face is brought into contact against both the side right, left external faces of the clamping plate portion so as to convert the clamping force with respect to the bolt in the horizontal direction and clamp a pair of right, left clamping plate portions in the mutually approaching directions.

As described hereinabove, both the side portions are formed in parallel to the clamping direction without the external expansion of both the side portions of the clamping equipment. A notch portion having the taper face opposite to a direction orthotropic to the clamping direction is provided in both the side portions parallel to the clamping direction. The clamping plate portion of the terminal main body is adapted to be clamped in the horizontal direction with the taper face. The clamping plate portion can be burdened positively as the clamping force in the horizontal portion without the escaping operation of the clamping force of the bolt in the externally spreading direction to be caused in the construction shown in the conventional FIG. 8.

The battery • terminal is adapted to be clamped from above in the vertical direction or the oblique direction without clamping operation of the bolt with the use of the impact wrench from the horizontal direction. There is an advantage capable of improving the operationality and having the safety during the operation without any interference of the impact wrench with the other components during the clamping operation. As the clamping force is not reduced in construction when the clamping force from above in the vertical direction or the oblique direction is converted into the clamping force in the horizontal direction, the terminal main body can be fixedly positively in pressure contact with respect to the battery • post.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A battery • terminal comprising a terminal main body having a pair of right and left clamping plate portions respectively coupled to opened free ends of a circular ring shaped electrode engagement portion, said engagement portion adapted to externally engage a battery • post, an electric wire connecting portion connected with one of the right and left clamping plate portions, a clamping element having a notch portion having faces spaced in a horizontal direction and diverging downwardly, said pair of right and left clamping plate portions of the terminal main body being inserted into the notch portion of the clamping element, a bolt being clamped from above with respect to a nut through a gap between the right and left clamping plate portions, the external ends of the right and left clamping plate portions being depressed by the tapered faces of the clamping element at the time of clamping so as to move the right and left clamping plate portions in mutually approaching horizontal directions, the electrode engagement portion being adapted to be put into pressure contact against an external peripheral face of the battery post.

2. A battery • terminal as defined in claim 1, further comprising guide grooves with which the tapered faces of both the side portions of the clamping element are engaged on the respective clamping plate portions.

3. A battery • terminal as defined in claim 1, wherein the clamping plate portion on an upper side is inclined with respect to an axial direction of the battery • post, and the bolt is clamped on a nut arranged, with the bolt being in contact with a lower face of the clamping plate portion on the upper side, from the oblique upper portion, with the clamping plate portion on the lower side being horizontal.

4. A battery • terminal as defined in claim 1, wherein the terminal main body has a pair of right and left clamping plate portions provided in the vertical direction, and respectively connected from a free end of an electrode engagement portion, a nut mounting hole being provided opposite to central portions of said clamping plate portions with both sides thereof being inserted into the nut mounting hole, so as to arrange a nut with a tapped hole in a central portion, the clamping element, having a notch portion provided on one side portion with a tapered face diverging downwardly oppositely in the horizontal direction, and the bolt being clamped on the nut with the tapered face being arranged on an external face of the pair of right and left clamping plate portions.

5. A battery • terminal as defined in claim 1, wherein the terminal main body has an electrode connection portion and an electrode engagement portion having upper and lower side portions with said pair of right and left clamping plate portions being respectively connected thereto, a tip end of a clamping plate portion being bent into a shape with both the upper and lower side portions being integrated, the nut being arranged in a gap portion between the upper and lower opposite faces of a pair of the right and left clamping plate portions, tapered faces being formed on both the side faces of the clamping element and adapted to come into pressure contact against respective external ends of the clamping plate portions.

6. A battery • terminal as defined in claim 5, wherein the pair of right and left tapered faces to be formed in the notch portion of the clamping plate portion comprises two stages of tapered faces respectively coming into pressure contact with the upper and lower clamping plate portions, a projection face being provided between the upper and lower clamping plate portions and being projected from the gap portion between the upper and lower clamping plates.

* * * * *